United States Patent [19]

Oku et al.

[11] Patent Number: 4,580,431

[45] Date of Patent: Apr. 8, 1986

[54] METHOD AND APPARATUS FOR PRODUCING A STEPPED HOLLOW ARTICLE

[75] Inventors: Masaharu Oku, Mito; Kazuo Sawahata, Hitachi; Hisanobu Kanamaru, Katsuta, all of Japan

[73] Assignee: Hitachi, Ltd., Tokyo, Japan

[21] Appl. No.: 576,338

[22] Filed: Feb. 2, 1984

[30] Foreign Application Priority Data

Feb. 2, 1983 [JP] Japan ..... 58-16815

[51] Int. Cl.[4] ..... B21D 28/32

[52] U.S. Cl. ..... 72/334; 72/354; 72/359

[58] Field of Search ..... 72/334, 338, 359, 358, 72/360, 354, 352, 353, 267; 29/159.2

[56] References Cited

U.S. PATENT DOCUMENTS

| | | | |
|---|---|---|---|
| 1,352,911 | 9/1920 | Paque | 72/354 |
| 2,586,336 | 2/1952 | Huck | 72/354 |
| 2,621,344 | 12/1952 | Friedman | 72/354 |
| 3,280,613 | 10/1966 | Schröm | 72/359 |
| 3,842,646 | 10/1974 | Kuhn | 72/359 |

FOREIGN PATENT DOCUMENTS

| | | | |
|---|---|---|---|
| 909168 | 9/1972 | Canada | 72/354 |
| 517077 | 10/1957 | Italy | 72/358 |
| 836706 | 6/1960 | United Kingdom | 72/358 |

*Primary Examiner*—Daniel C. Crane

*Attorney, Agent, or Firm*—Antonelli, Terry & Wands

[57] ABSTRACT

A method and apparatus for producing a stepped hollow component such as, for example, a gear blank. A solid slug, provided with a disc portion and a projecting portion, is placed in a rigid cylindrical recess formed between a counterpunch and a hollow mold. An annular upper surface of the disc portion and a side surface of the projecting portion are precompressed by an outer punch so as to restrain an outer periphery of the solid slug. A closed-base hole is formed in a center of the solid slug by a plastic deformation caused by an inner punch. The plastic deformation by the inner punch causes material of the solid slug to flow biaxially in the radial and axial direction of the solid slug.

6 Claims, 8 Drawing Figures

METHOD AND APPARATUS FOR PRODUCING A STEPPED HOLLOW ARTICLE

BACKGROUND OF THE INVENTION

The present invention relates to a cold forming method and apparatus for producing a stepped hollow component such as, for example, a gear blank.

In, for example, "Impact Machining", page 57, FIG. 3.19, Verson Co., Corona-Sha, a method is proposed which employs six press steps between the cutting of a metal bar and a final coining operation. More particularly, between the cutting and final coining operation at least two annealing steps and three lubrication treatments are required. Moreover, in the proposed method it is necessary to provide a relatively large capacity press in order to bear the heavy processing load which occurs particularly during rearward and forward extrusion steps; however, a disadvantage of the requirement for a large capacity press resides in the fact that a service life of the molds is significantly reduced by virtue of the high pressure applied to them during the press operation. Furthermore, an excessive number of steps in the proposed method tends to reduce a dimensional accuracy of the produced stepped hollow component.

The aim underlying the present invention essentially resides in providing a method and apparatus for producing stepped hollow components, which method and apparatus reduce the processing load while also reducing the number of process steps to which the hollow components must be exposed thereby increasing the overall dimensional accuracy of the produced component.

In accordance with advantageous features of the present invention, a stepped hollow article or component is attained by placing a solid slug provided with a disc portion and projecting portion in a rigid cylindrical recess, restraining an outer periphery of the disc portion and a side surface of the projectiong portion, and forming a closed-base hole in a center of the solid slug by a plastic deformation.

Advantageously, in accordance with further features of the present invention, for the purposes of restraining the outer periphery of the disc portion and side surface of the projecting portion, an annular lower surface and the side surface of the disc portion are restrained and an annular upper surface of the disc portion is precompressed so as to simultaneously restrain the side surface of the projecting portion.

In order to form the closed-base hole in the center of the solid slug, in accordance with the present invention, a press member is driven into the center of the projecting portion. Additionally, the press member may be driven to the point so as to punch out the base forming the closed hole in the center of the solid slug.

The rigid cylindrical recess may, in accordance with the present invention, be formed between a hollow mold and a counter punch, with the hollow mold accommodating the disc portion and the counter punch being adapted to fit into a lower part of a central bore of the hollow mold. Advantageously, the precompressing of the annular upper surface of the disc portion is accomplished by an outer punch fitting into the central bore in the hollow mold so as to simultaneously restrain the side surface of the projecting portion. An inner punch, fitting into a central bore of the outer punch is independently driven into the center of the projecting portion, with the plastic deformation being caused by the inner punch whereby the material of the solid slug flows biaxially in the radial and axial directions of the solid slug.

In accordance with advantageous features of the apparatus of the present invention, a first means is provided for mounting a solid slug provided with the disc portion and the projecting portion, with a second means being provided for accommodating the disc portion and the first means which is adapted to fit into the lower part of the central bore of the second means so that a recess is formed therebetween. Third means are adjustably fitted into the upper part of the central bore of the second means for precompressing an annular upper surface of the disc portion so as to restrain an outer periphery of the disc portion and the side surface of the projecting portion of the solid slug. A fourth means is fitted into a central bore of the third means and is driven independently for forming a closed base hole in a center of the projecting portion by plastic deformation which causes the material of the solid slug to flow biaxially in the radial and axial directions of the solid slug.

Advantageously, in accordance with further features of the present invention, the third means is arranged to be moved upwardly so as to absorb excessive forces caused in an axial direction of the boss portion by the plastic flow of material when the fourth means is operated.

An object of the present invention resides in providing a method and apparatus which enables the production of stepped hollow components with a high dimensional accuracy by using a minimum of processing steps in a low load by cold forming.

Another object of the present invention resides in providing a method and apparatus which relies upon a biaxial plastic flow, namely, in radial and axial directions, so as to enable a reduction in the working pressure and ensure a high precision process and article.

Another object of the present invention resides in providing a method and apparauts for producing a stepped hollow component which avoids, by simple means, shortcomings and disadvantages encountered in the prior art.

Yet another object of the present invention resides in providing a method and apparatus for producing stepped hollow components which may be readily carried out without the use of large capacity presses.

Yet another object of the present invention resides in providing a method and apparatus for producing a stepped hollow component which may be formed by a single press operation.

A still further object of the present invention resides in providing a method and apparatus for producing a stepped hollow component by cold forming which enables a marked improvement in the overall production efficiency.

These and other objects, features, and advantages of the present invention will become more apparent from the following description when taken in connection with the accompanying drawings which show, for the purposes of illustration only, several embodiments in accordance with the present invention.

DETAILED DESCRIPTION

Figure 1:
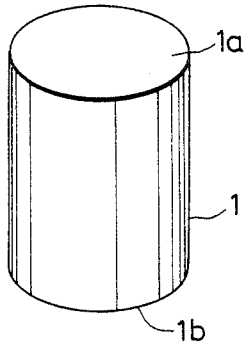
FIG. 1 is a perspecitve view of a cylindrical metallic member used for forming a solid slug.
Figure 2:
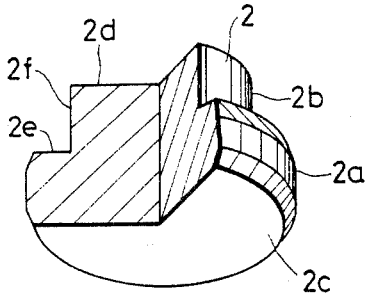
FIG. 2 is a perspective view of a solid slug formed from a metallic member of FIG. 1.

Referring now to the drawings wherein like reference numerals are used throughout the various views and, more particularly, to FIGS. 1–4, according to these figures, a cylindrical metallic member 1 is cut from a round metallic bar so as to have a predetermined volume or weight, with upper and lower end surfaces 1*a*, 1*b* of the cylindrical metallic member 1 being displosed in parallel with each other. A solid slug 2 is formed from the cylindrical metallic member 1. For this purpose, the solid slug 2 is mounted in a hollow mold 11 in the manner shown most clearly in the left hand portion of FIG. 5 and is formed in the manner shown in the right hand portion of FIG. 5. The slug 2 is further processed in the manner shown in FIG. 6 so as to form a slug 3 with a central closed hole 3*e*. The slug 3 is formed into a stepped hollow component 4 by punching out of the base of the slug 3 by a press (not shown).

Figure 3:
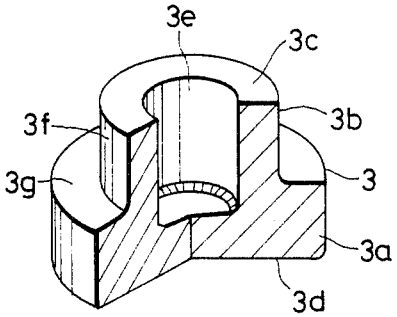
FIG. 3 is a perspective view of a slug with a central closed hole formed from the solid slug shown in FIG. 2.

As shown in FIG. 3, the slug 3 includes a disc-like flange portion 3*a*, having a lower surface portion 3*d* and an upper surface 3*g*, and a boss portion 3*b* in the form of an annular projection, with the boss portion 3*b* including an upper end surface 3*c*. A closed hole 3*e* is formed in a center of the boss portion 3*b*.

Figure 5:
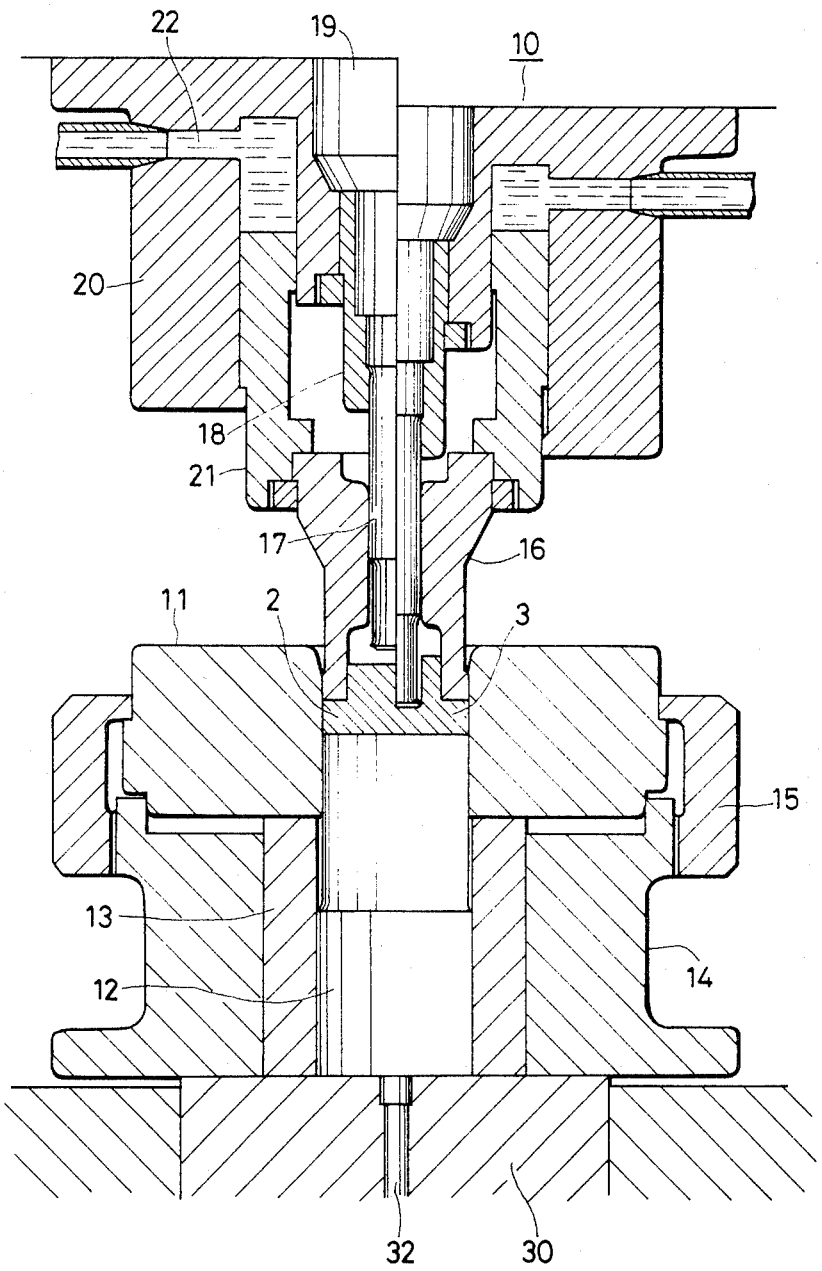
FIG. 5 is a partial vertical cross sectional view of a cold forming apparatus constructed in accordance with the present invention.

As shown most clearly in FIG. 5, a cold forming apparatus for producing the stepped hollow component 4 includes a hard plate 13 fixed into a central bore formed in a pedestal 14 mounted on a rigid base 30, and a counter punch 12 mounted within the hard plate 13. A hollow mold 11 is placed on top of the hard plate 13 and is secured to the pedestal 14 by fastening member 15 which are, for example, threadably secured to the pedestal 14. The solid slug 2 is positioned in a recess formed by the hollow mold 11 and an upper surface of the counter punch 12 fitting in the central bore.

A movable pressurizing portion 10 is disposed above the hollow mold 11 and pressure in an oil passage 22, provided in a cylinder block 20, is increased by a pressure control member (not shown) to lower a piston block 21 so that a lower end of the outer punch 16, attached to the lower end of the piston block 21, contacts the annular upper surface 2*e* of the solid slug 2 and the side surface 2*f* of the projecting portion thereby restraining the solid slug 2. Subsequently, as a pressure receiving member 19 of a cylindrical member positioned within the central bore of the cylinder block 20 through a holder 18 is depressed or lowered, a lower end of the inner punch 17 comes into contact with the solid slug 2 so that it pushes the boss portion 3*b* backward while forming the flange portion 3*a*. More particularly, a plastic flow takes place not unit axially but biaxially in both the radial and axial direction.

Figure 6:
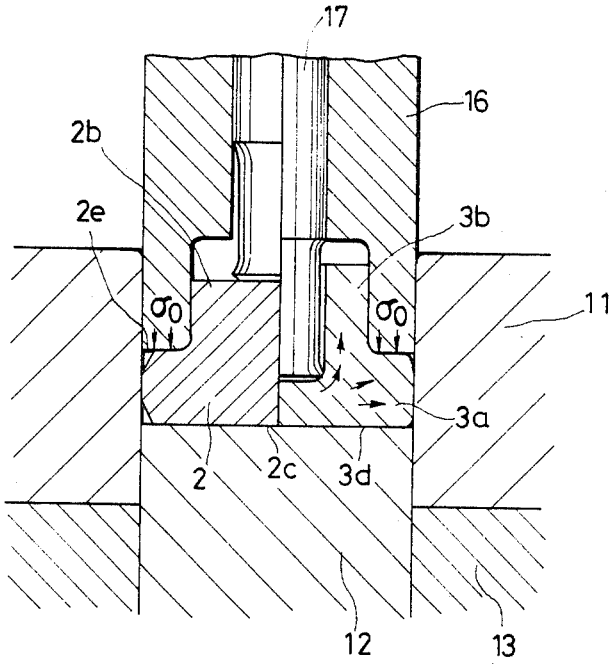
FIG. 6 is a cross sectional view, on an enlarged scale, of a detail of the cold forming apparatus of FIG. 5.

As shown in FIG. 6, while the hydraulically-operated outer punch 16 imparts a force $\delta_0$ to the annular upper surface 2*e* of the solid slug 2, the material of this region flows in a direction of the arrows as a result of the lowering of the inner punch because the lower surface 2*c* is prevented from moving by the counter punch 12. Consequently, the outer configuration of the flange portion 3*a* of the slug 2 is changed from a barrel shape to a cylindrical shape, while the boss portion 2*b* is elongated in an upward direction so that the slug assumes the shape shown most clearly in FIG. 3. The pressure applied to the annular upper surface 2*e* through the outer punch 16 is adjustable and the outer punch 16 is arranged so as to be moved upwardly so as to absorb the excessive force caused in the axial direction of the boss portion 3*b* by the plastic flow of the material when the inner punch 17 is lowered so that the region between the upper surface 3*g* of the flange portion 3*a* and the side surface 3*f* of the boss portion 3*b* is free from the generation of cracks.

Thereafter, a force applied to the pressure receiving surface 19 is relaxed so as to allow the cylinder block 20 to move upwardly and separate the outer punch 16 and the inner punch 17 from the slug 3, with the slug 3 being removed as the counter punch 12 is raised by a push rod 32 provided in a central bore in the rigid base 30. The slug 3 can be removed from the hollow mold 11 without much difficulty if an application of oil and a punch-treatment are performed before the solid slug 2 is placed in the hollow mold 11.

Figure 4:
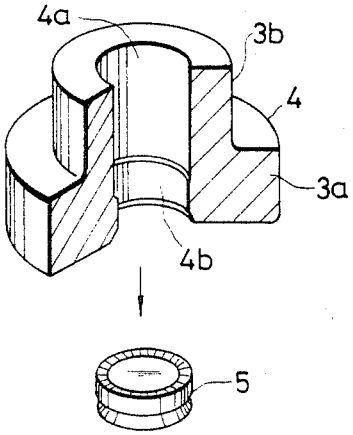
FIG. 4 is a perspective view of a stepped hollow component formed by the method and apparatus of the present invention.

As shown in FIG. 4, in the stepped hollow component 4, a punched-out portion 4*b* in the lower part of the hole 4*a* is a region from which a waste part 5 has been removed and it has a smooth surface although an annular line remains. The punching out of the hole bottom can be accomplished easily by a simple press (not shown). Annealing is thereafter conducted to remove residual stresses and obtain the stepped hollow component 4 which is suitable for use as, for example, a gear blank in which teeth are cut in the flange portion.

In accordance with the method of the present invention for producing a stepped hollow component 4, a slug with a flange portion 3*a* and a boss portion 3*b* can easily be obtained by the process which comprises the steps of placing a solid slug 2 provided with a disk portion and a projecting portion in the form of a cylindrical bar into a rigid cylindrical recess, restraining the annular upper surface of the disc portion and side surface of the projection portion by an annular edge of an outer punch 16, and driving an inner punch 17 into the center of the projecting portion. From this slug 3, a stepped hollow component 4 can easily be obtained simply by punching out the base of the hole into which the inner punch 17 was driven.

One advantage of the method of the present invention over conventional methods resides in the fact that the flange portions 3*a* and boss portion 3*b* of the stepped hollow component 4 with a closed central hole can be formed simultaneously in one action by a cold forming apparatus of the type illustrated in FIGS. 5 and 6 so that the production efficiency can be markedly improved. Moreover, in conventional methods which employ a plurality of steps, i.e., a plurality of annealings and a plurality of bonderizing treatments, in accordance with the method of the present invention, the annealing and bonderizing treatment need only be carried out once.

Furthermore, since the hollow component 4 can, in accordance with the method and apparatus of the present invention, be formed by a single press operation, the number of molds is reduced and the pressure force can be adjusted to a minimum required level. More particularly, since plastic flow takes place not uniaxially but biaxially in the radial and axial direction, the working pressure is reduced so as to ensure a high precision process.

Figure 7:
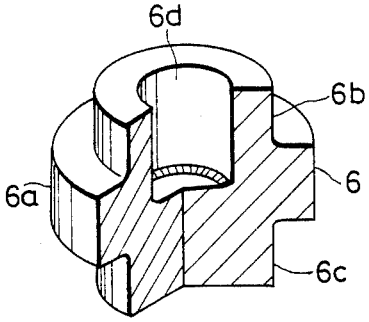
FIG. 7 is a partial cross sectional perspective view of a slug with a central closed hole formed in accordance with the method and apparatus of the present invention.
Figure 8:
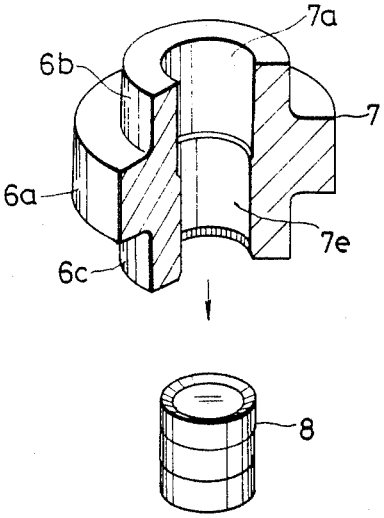
FIG. 8 is a perspective partial cross sectional view of another embodiment of a stepped hollow component formed in accordance with the method and apparatus of the present invention.

FIGS. 7 and 8 provide another example of a stepped hollow component which may be produced in accordance with the method and apparatus of the present invention. More particularly, as shown in FIGS. 7 and 8, boss portions 6*b*, 6*c* are formed on upper and lower sides of a flange portion 6*a* so that the slug 6 of FIGS. 7 and 8 differ from that of FIG. 3 in that a boss portion 6*c* is also formed on a lower surface of the flange 6*a*. A closed hole 6*d* is formed, in the manner described hereinabove, by an inner punch 17 disposed above the slug 6. An upper surface of the counterpunch 12 described hereinabove is provided with a recess (not shown) for receiving or accommodating the boss portion 6*c*. The slug 6 is formed by the same process as that which produces the slug 3 of FIG. 3, that is, using the cold forming apparatus of FIG. 5.

As shown in FIG. 8, by punching out a base of the closed hole 6*d*, it is possible to produce a stepped hollow component 7 from a relatively simple slug 6, with the stepped hollow component 7 being provided with a hole 7*a*, a punched portion 7*e*, and a punched out waste portion 8.

By virtue of the method and apparatus for producing the stepped hollow component 7, it is possible to provide a stepped hollow component 7 having boss portions on both sides thereof, with the hollow component 7 being produced with a high efficiency and with good structural accuracy by using a counter punch of the same type that is used in the first described embodiment, with such counter punch being provided, on an upper surface thereof, with a recess for receiving or accommodating the lower boss portion 6*c*.

While we have shown and described several embodiments in accordance with the present invention, it is understood that the same is not limited thereto, but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A method of producing a stepped hollow article, the method comprising the steps of:

placing a solid slug provided with a disc portion and a projection portion having an annular upper surface on the disc portion extending between an outer peripheral side surface of the projecting portion and an outer peripheral side surface of the disc portion in a rigid cylindrical recess;

restraining said outer peripheral side surface of the disc portion and said outer peripheral side surface of the projecting portion of the solid slug by restraining an annular lower side surface of the disc portion of the solid slug, and by precompressing said annular upper surface of the disc portion so as to simultaneously restrain the side surface of the projecting portion of the solid slug; and forming a closed base hole in a center of the solid slug by a plastic deformation which causes material of the solid slug to flow biaxially in radial and axial directions of the solid slug including driving a press means into a center of the projecting portion of the solid slug.

2. A method of producing a stepped hollow article according to claim 1, further comprising the step of punching out a base of the closed-based hole of the slug.

3. A method of producing a stepped hollow article, the method comprising the steps of:

placing a solid slug with a disc portion and a projecting portion in the form of a cylindrical bar having an annular upper surface on the disc portion extending between an outer peripheral side surface of the projecting portion and an outer peripheral side surface of the disc portion into a rigid cylindrical recess formed between a hollow mold and a counterpunch, the hollow mold accommodating the disc portion and the counterpunch fitting into a lower part of a central bore of the hollow mold;

restraining an annular lower surface and a side surface of the disc portion by the counterpunch and the hollow mold;

precompressing said annular upper surface of the disc portion by an outer punch fitting into the central bore in the hollow mold so as to simultaneously restrain the side surface of the projecting portion;

independently driving an inner punch fitting into a central bore of the outer punch into a center of the projecting portion; and forming a closed-base hole in a center of the solid slug by plastic deformation caused by the inner punch.

4. A method of producing a stepped hollow article according to claim 3, wherein the step of forming includes displacing the inner punch in such a manner so as to cause material of the solid ring to flow in both radial and axial direction of the solid slug.

5. A method of producing a stepped hollow article according to claim 3, further comprising the step of punching out a base of the closed-base hole.

6. An apparatus for producing a stepped hollow article, the apparatus comprising:

first means for mounting a solid slug provided with a disc portion and a projecting portion;

second means for accommodating the disc portion and the first means which fits into a lower part of a central bore of the second means so that a recess is formed therebetween;

driven third means adjustably fitted into an upper part of the central bore of the second means for precompressing an annular upper surface of the disc portion so as to restrain an outer periphery of the disc portion and an outer peripheral side surface of the projecting portion of the solid slug; and independently driven fourth means fitted into a central bore of the third means forming a closed-based hole in a center of the projecting portion by a plastic deformation which causes material in the solid slug to flow biaxially in the radial and axial directions of the solid slug; and wherein the third means is arranged so as to be moved upwardly to absorb excessive force caused in an axial direction of the boss portion by the plastic flow of the material when the fourth means is driven.

* * * * *